US011402775B2

(12) United States Patent
Kurata

(10) Patent No.: US 11,402,775 B2
(45) Date of Patent: Aug. 2, 2022

(54) IMAGE HEATING APPARATUS AND IMAGE FORMING APPARATUS

(71) Applicant: CANON KABUSHIKI KAISHA, Tokyo (JP)

(72) Inventor: Munehito Kurata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/141,425

(22) Filed: Jan. 5, 2021

(65) Prior Publication Data

US 2021/0124293 A1 Apr. 29, 2021

Related U.S. Application Data

(63) Continuation of application No. 16/521,173, filed on Jul. 24, 2019, now Pat. No. 10,983,461.

(30) Foreign Application Priority Data

Jul. 27, 2018 (JP) ..... JP2018-141390

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042
See application file for complete search history.

(56) References Cited

U.S. PATENT DOCUMENTS

| | | | |
|---|---|---|---|
| 5,563,696 | A | 10/1996 | Futagawa et al. |
| 5,640,231 | A | 6/1997 | Mitsui et al. |
| 5,742,865 | A | 4/1998 | Yajima et al. |
| 6,668,144 | B2 | 12/2003 | Maruyama |
| 7,079,802 | B2 | 7/2006 | Katayanagi et al. |
| 8,744,296 | B2 | 6/2014 | Fukuzawa et al. |
| 8,918,001 | B2 | 12/2014 | Kurata et al. |
| 9,122,212 | B2 | 9/2015 | Fujimoto et al. |
| 9,405,249 | B2 | 8/2016 | Hirai et al. |
| 9,547,264 | B2 | 1/2017 | Kurata et al. |
| 2002/0003970 | A1 | 1/2002 | Goto et al. |
| 2002/0071688 | A1 | 6/2002 | Maruyama |
| 2004/0190924 | A1 | 9/2004 | Iwasaki et al. |
| 2005/0031363 | A1 | 2/2005 | Nishi |
| 2006/0051117 | A1 | 3/2006 | Nishida |
| 2007/0217810 | A1 | 9/2007 | Minagawa |
| 2008/0253789 | A1 | 10/2008 | Yoshinaga et al. |
| 2008/0260406 | A1 | 10/2008 | Sone et al. |
| 2009/0074436 | A1 | 3/2009 | Murakami |

(Continued)

FOREIGN PATENT DOCUMENTS

| | | | |
|---|---|---|---|
| JP | H06-95540 | A | 4/1994 |
| JP | 2002-182518 | A | 6/2002 |

(Continued)

*Primary Examiner* — David J Bolduc
(74) *Attorney, Agent, or Firm* — Venable LLP

(57) ABSTRACT

The present invention provides an image heating apparatus including an acquiring portion which acquires thickness information of a recording material, and a control portion controls a power to be supplied to a heating element which heats a region where the recording material does not pass through among a plurality of heating regions based on a control target temperature which is set based on the thickness information.

12 Claims, 10 Drawing Sheets

(56) References Cited

U.S. PATENT DOCUMENTS

| | | | | |
|---|---|---|---|---|
| 2009/0148176 | A1 | 6/2009 | Shida | |
| 2009/0208238 | A1 | 8/2009 | Higashi et al. | |
| 2009/0252506 | A1 | 10/2009 | Misawa | |
| 2010/0014880 | A1 | 1/2010 | Kinouchi et al. | |
| 2011/0123213 | A1* | 5/2011 | Yoda ..... | G03G 15/2039 399/69 |
| 2011/0164890 | A1 | 7/2011 | Ota | |
| 2011/0206402 | A1 | 8/2011 | Yamashina | |
| 2012/0148280 | A1 | 6/2012 | Sato | |
| 2013/0101305 | A1 | 4/2013 | Katakura | |
| 2014/0023389 | A1 | 1/2014 | Ono | |
| 2014/0133877 | A1 | 5/2014 | Samei et al. | |
| 2014/0219696 | A1 | 8/2014 | Fujimoto et al. | |
| 2014/0270834 | A1 | 9/2014 | Seshita et al. | |
| 2015/0347885 | A1 | 12/2015 | Haruta et al. | |
| 2016/0033910 | A1 | 2/2016 | Shimokawa et al. | |
| 2016/0062286 | A1 | 3/2016 | Yoshiura et al. | |
| 2017/0038710 | A1 | 2/2017 | Tamura | |
| 2018/0004134 | A1 | 1/2018 | Nomura et al. | |
| 2018/0004136 | A1 | 1/2018 | Iwasaki | |
| 2018/0267442 | A1 | 9/2018 | Yoshioka et al. | |
| 2019/0302668 | A1 | 10/2019 | Hirst et al. | |

FOREIGN PATENT DOCUMENTS

| | | | |
|---|---|---|---|
| JP | 2014-153507 | A | 8/2014 |
| JP | 2016-114914 | A | 6/2016 |

* cited by examiner

IMAGE HEATING APPARATUS AND IMAGE FORMING APPARATUS

CROSS-REFERENCE TO RELATED APPLICATIONS

This application is a Continuation of U.S. patent application Ser. No. 16/521,173, filed Jul. 24, 2019, which claims the benefit of Japanese Patent Application No. 2018-141390, filed Jul. 27, 2018. The entire contents of those applications are hereby incorporated by reference herein.

BACKGROUND OF THE INVENTION

Field of the Invention

The present invention relates to an image forming apparatus, such as a printer, a copier and a facsimile, which uses an electrophotographic system or an electrostatic recording system. The present invention also relates to an image heating apparatus, such as a glossing apparatus, which improves the glossiness of a toner image by reheating a toner image fixed to a fixing unit or a recording material include in the image forming apparatus. Further, the present invention relates to a heater used for the image heating apparatus.

Description of the Related Art

As an image heating apparatus included in an image forming apparatus, a method of selectively heating an image portion formed on a recording material has been proposed (e.g. Japanese Patent Application Publication No. H06-95540, Example 11) in order to conserve power. According to this method, a heating range of the heater is divided into a plurality of heating blocks in the longitudinal direction of the heater (direction orthogonal to the transporting direction of the recording material), and heating is controlled selectively for each heating block depending on whether an image exists on the recording material or not. In other words, power is conserved by not energizing a heating block in a portion where an image does not exist (non-image portion) on the recording material.

The size of the recording material that can be passed to the image heating apparatus varies (here a recording material having a maximum size that can be passed is called a "large sized paper", and a recording material of which width is smaller than the large sized paper is called a "small sized paper").

Japanese Patent Application Publication No. H06-95540 proposes a method of stopping energization of a heating block located in a region where paper does not pass through (non-paper passing region) when a small sized paper is passed.

In a method of controlling the energization of each heating block depending on whether an image exists or not and whether a region is a paper passing portion or a non-paper passing portion, a heating block corresponding to a non-image portion or a non-paper passing portion may be controlled such that not only is energization stopped, as described in Japanese Patent Application Publication No. H06-95540, but also the heating value of this block becomes lower than that of the image portion or the paper passing portion.

A recent well known technique is a media sensor which determines a type of recording material by detecting the surface state and a basis weight of the recording material. An example of a media sensor is disclosed in Japanese Patent Application Publication No. 2002-182518, for example.

SUMMARY OF THE INVENTION

In the film heating type image heating apparatus, as mentioned above, if a small sized paper, such as an envelope and a postcard, is passed, a dent or scratch may be generated due to local abrasion in a position of the film corresponding to the paper edge of the small sized paper in the width direction. Particularly in the case of thick paper, such as an envelope and postcard, the pressure applied to the film at the edges of the paper tends to be high, and local abrasion easily occurs at a paper edge position. This dent and scratch caused by local abrasion of the film tend to be generated when the transporting velocity of the paper is different from the rotation velocity of the film in the fixing nip of the image heating apparatus. This is because in the case where the transporting velocity of the paper is different from the rotational velocity of the film, friction is generated between the paper and the film while the paper is being transported through the fixing nip, and the surface of the film is scraped by the paper.

In the case of the film heating type image heating apparatus, when the pressure roller is rotary-driven by a motor or the like, the film rotates along with the pressure roller because of the friction force between the surface of the pressure roller and the surface of the film. If a small sized paper is passed, the film is rotary-driven mainly by the friction force at a region in the non-paper passing portion where the film and the pressure roller directly contact. Therefore the rotational peripheral velocity of the film becomes approximately the same as the rotational peripheral velocity of the surface of the pressure roller in the non-paper passing region. Generally the rotational peripheral velocity V on the surface of a rotating body is expressed using a radius of the rotating body and the rotational angular velocity thereof, that is, V=radius×rotational angular velocity. When the radius of the pressure roller is r and the rotational angular velocity of the motor is ω, the rotational peripheral velocity Vp on the surface of the pressure roller is given by $Vp=r\times\omega$. As mentioned above, the rotational peripheral velocity Vp of the film is the same as the rotational peripheral velocity Vp of the pressure roller. On the other hand, the transporting velocity Vs of the surface of the paper which is being passed is $Vs=(r+d)\times\omega$, if the thickness d of the paper is considered in addition to the radius r of the pressure roller.

Actually, however, the pressure roller has an elastic layer which is made of silicon rubber or the like, hence the radius thereof changes due to thermal expansion. While a recoding material is being passed, the temperature of the pressure roller in the longitudinal direction changes depending on the existence of the recording material and the above mentioned control state of each heating block, which means that the radius of the pressure roller may be different in the longitudinal direction.

When the radius of the pressure roller in the paper passing portion is r [paper passing portion] and the radius of the pressure roller in the non-paper passing portion is r [non-paper passing portion], the transporting velocity Vs of the surface of the recording material in the paper passing portion is $$Vs=(r[\text{paper passing portion}]+d)\times\omega$$

and the rotational peripheral velocity Vf of the film is the same as the rotational peripheral velocity of the pressure roller in the non-paper passing portion, that is $$Vf=r[\text{non-paper passing portion}]\times\omega.$$

In the case of stopping the energization of the heating block of the non-paper passing portion, as in the case of Japanese Patent Application Publication No. H06-95540, in some cases the pressure roller temperature in the paper passing portion becomes higher than the pressure roller temperature in the non-paper passing portion, and in some cases r [paper passing portion]>r [non-paper passing portion] occurs due to thermal expansion. Further, as the thickness d of the small sized paper to be passed is thicker, r [paper passing portion]+d>r [non-paper passing portion] is more likely to occur, and in some cases Vs>>Vf occurs.

As mentioned above, if the small sized paper is continuously passed in a state where Vs and Vf are different, dents and scratches may be generated due to local abrasion of the film.

If a large sized paper is passed in a state where dents and scratches are generated due to local abrasion of the surface of the film caused by passing small sized paper, an image defect (gloss unevenness, fixing defect) may be generated in a portion where dents and scratches are generated.

The object of the present invention is to suppress the generation of local abrasion of the surface of the film, and to provide a technique that can suppress the generation of such image defects as gloss unevenness and a fixing defect.

To achieve the above object, an image heating apparatus of the present invention includes:

an image heating portion, which includes a heater having a plurality of heating elements which are arranged in a direction orthogonal to a transporting direction of a recording material, the image heating portion heats an image formed on the recording material using a heat of the heater; and a control portion which controls the plurality of heating elements individually, wherein the image heating apparatus includes an acquiring portion which acquires thickness information of the recording material, wherein the control portion controls a power to be supplied to the heating element which heats a region where the recording material does not pass through among the plurality of heating elements based on a control target temperature which is set based on the thickness information.

To achieve the above object, an image forming apparatus of the present invention includes:

an image forming portion which forms an image on a recording material; and a fixing portion which fixes an image formed on a recording material to the recording material, wherein the fixing portion is the image heating apparatus of the present invention.

According to the present invention, the generation of local abrasion of the surface of the film is suppressed, and the generation of such image defects as gloss unevenness and a fixing defect can be suppressed.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Figure 1:
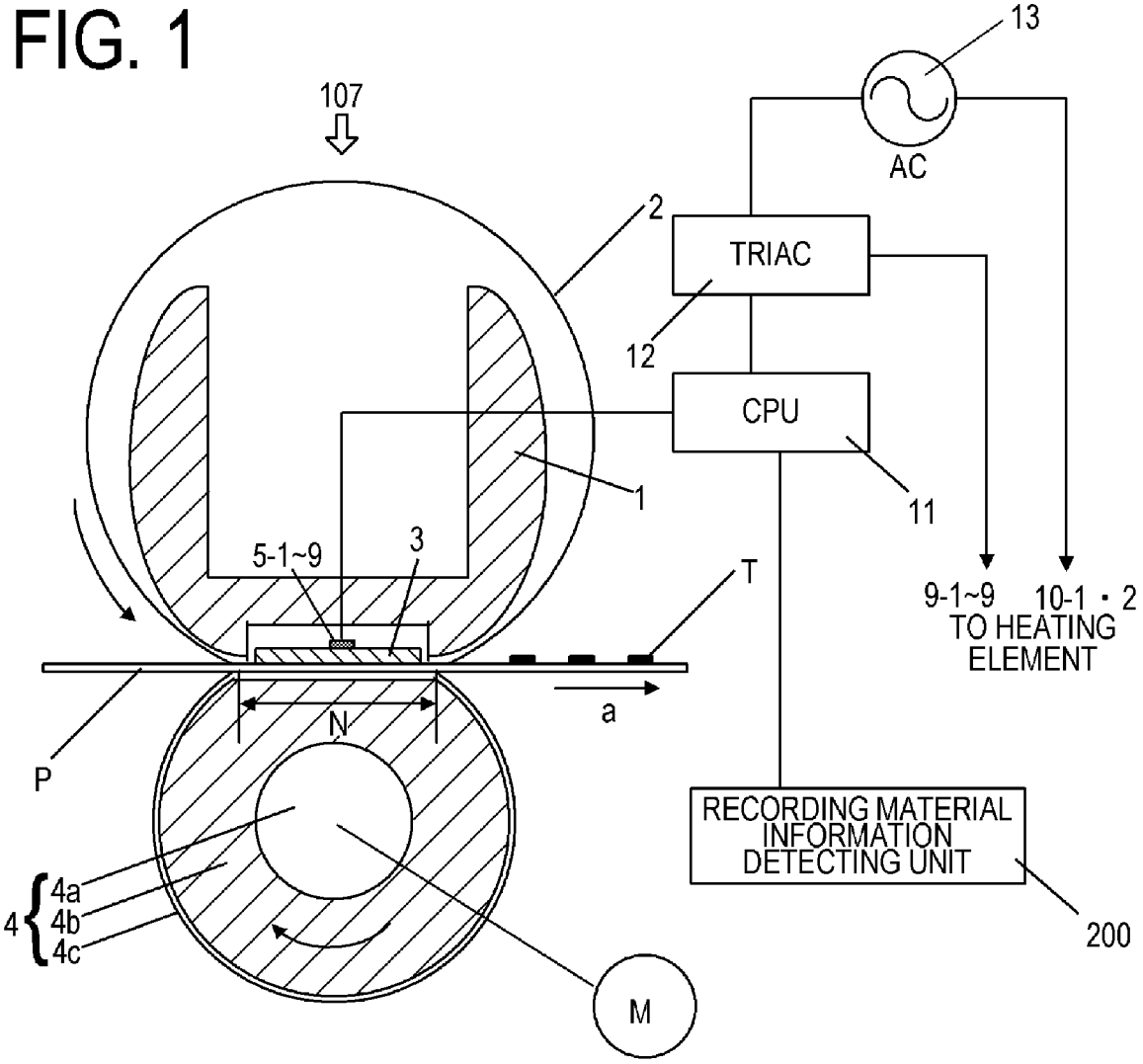
FIG. 1 is a schematic block diagram depicting an image heating apparatus according to Example 1.

FIG. 1 is a cross-sectional view of a laser printer (image forming apparatus) 100 using the electrophotographic recording technique. Image forming apparatuses to which the present invention can be applied are a printer, a copier, a facsimile and the like, which uses the electrophotographic system or the electrostatic recoding system, and a case of applying the present invention to a laser printer, which forms an image on a recording material P using the electrophotographic system, will be described here.

Unless otherwise specified, the phrase "longitudinal direction" in the following description is the same direction as the longitudinal direction of the heater (substrate) and the direction that is orthogonal to the transporting direction of the recording material (the width direction of the recording material which is not oblique, or the shorter side direction of the recording material which is transported vertically which is not oblique). The phrase "lateral direction" is the direction that is orthogonal to the above mentioned "longitudinal direction", and is the same direction as the same direction as the transporting direction of the recording material (the length direction of the recording material which is not oblique and the longer side direction of the recording material which is transported vertically which is not oblique.

(1) Example of Image Forming Apparatus

Figure 10:
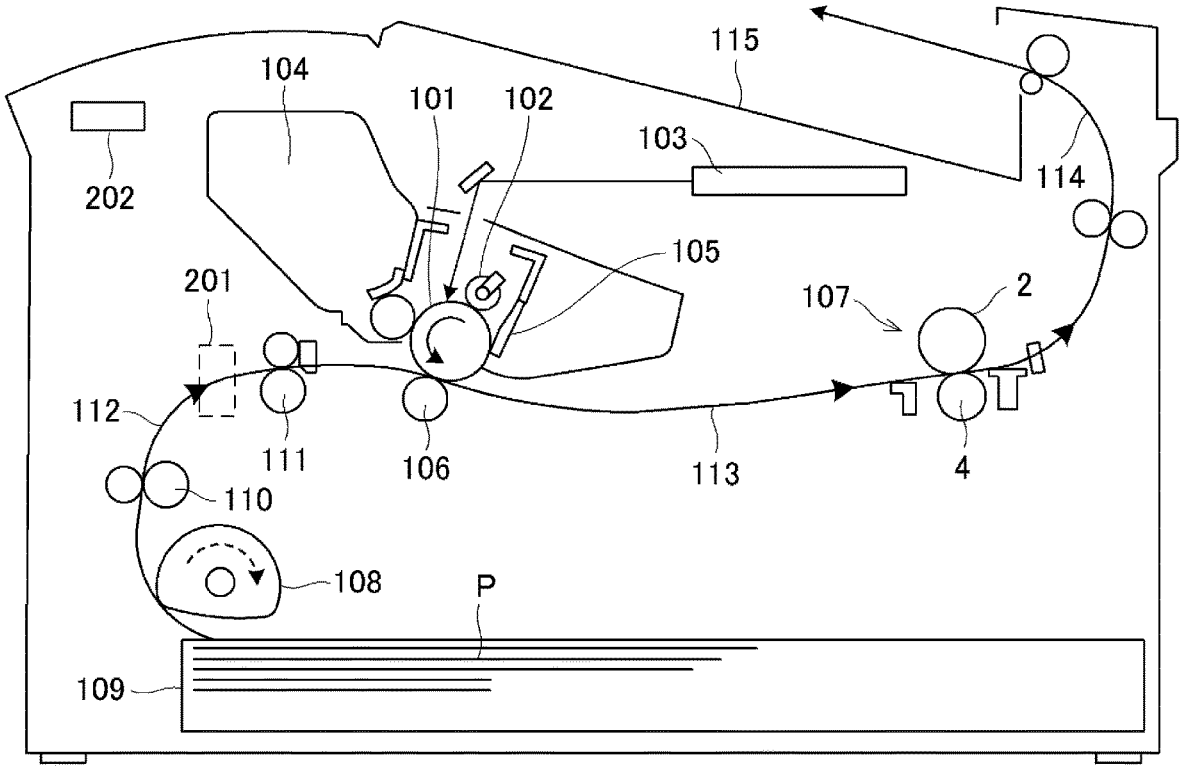
FIG. 10 is a schematic block diagram depicting an example of the image forming apparatus according to the present invention.

FIG. 10 is a schematic block diagram depicting an example of an image forming apparatus which includes an image heating apparatus according to Example 1. The image forming apparatus of Example 1 is a laser printer using a transfer type electrophotographic process. The maximum width of the paper that can be passed in the image forming apparatus of Example 1 is A4 size (paper width: 210 mm). 101 indicates an electrophotographic photosensitive drum, which is an image bearing member, and is rotary-driven in a counterclockwise direction indicated by the arrow, at a predetermined peripheral velocity (process speed). The process speed of the image forming apparatus of Example 1 is 300 mm/sec. 102 indicates a charging unit, such as a contact charging roller, and by this charging unit, the surface of the photosensitive drum 101 is uniformly charged (primary charging) to a predetermined polarity and potential. 103 indicates a laser scanner, which is an image exposing unit. The laser scanner 103 outputs laser light of which ON/OFF is modulated corresponding to the time series electric digital pixel signals of the target image information, which is inputted from such an external apparatus as an image scanner and computer (not illustrated), and performs scanning exposure (irradiation) on the charging processing surface of the photosensitive drum 101. When the charges of the exposure light portion of the surface of the photosensitive drum 101 are eliminated by this scanning exposure, an electrostatic latent image, corresponding to the target image information, is formed on the surface of the photosensitive drum 101.

104 indicates a developing apparatus, where developer (toner) is supplied from the developing sleeve onto the surface of the photosensitive drum 101, and an electrostatic latent image on the surface of the photosensitive drum 101 is sequentially developed as a toner image, which is a visible transferred image. In the case of the laser printer, a reversal development system, which adheres toner to the exposure light portion of the electrostatic latent image and develops the toner image, is normally used.

109 is a paper feeding cassette, where recording materials are stacked and stored. Based on a paper feeding start signal, a paper feeding roller 108 is driven, and the recording materials P in the paper feeding cassette 109 are separated and fed one-by-one. Then each recording material P passes through a sheet path 112, which includes a transporting roller 110 and a resist roller 111, and enters a transfer area, which is a contact nip portion between the photosensitive drum 101 and a transfer roller 106 as a contact and rotating type transfer member at a predetermined timing. In other words, transporting of the recording material P is controlled by the resist roller 111, so that the tip of the recording material P reaches the transfer area precisely when the tip of the toner image on the photosensitive drum 101 reaches the transfer area.

A media sensor 201 is disposed on the sheet path 112 so as to detect the surface properties and the basis weight of the recording material P, which is transported through the sheet path 112. The detection result by the media sensor 201 is sent to the recording material information detecting unit 200, which is an acquiring unit (see FIG. 1).

The recording material P, which entered the transfer area, is held and transported through the transfer area, and during this time, a predetermined transfer voltage (transfer bias) is applied from a transfer bias applying power supply (not illustrated) to the transfer roller 106. For the transfer roller 106, which is a contact and rotating type transfer member, an elastic sponge roller is normally used, and the elastic sponge roller is created by forming a semiconductive sponge elastic layer, of which resistance is adjusted to about $1\times10^{6}$ to $1\times10^{10}\Omega$ by carbon ion conductive filter or the like, on a core metal (e.g. Fe). In Example 1, an ion conductive transfer roller is used, which is created by concentrically molding a conductive elastic layer into a roller shape, around a core metal, by reacting NBR rubber and a surface active agent and the like. The resistance value thereof is in the range of $1\times10^{8}$ to $5\times10^{8}\Omega$.

A transfer bias having an opposite polarity of the toner is applied to the transfer roller 106, whereby the toner image on the surface of the photosensitive drum 101 is electronically transferred onto the surface of the recording material P in the transfer area.

The above mentioned configuration of the image forming apparatus related to forming an unfixed toner image on the recording material P corresponds to the image forming portion of the present invention.

The recording material P, on which the toner image was transferred in the transfer area, is separated from the surface of the photosensitive drum 101, and is transported into a fixing apparatus (image heating apparatus) 107, which is a fixing portion (image heating portion) via the sheet path 113, and heating and press-fixing processing is performed on the toner image.

On the other hand, the surface of the photosensitive drum 101, after the recording material is separated (after the toner image is transferred to the recording material P), is cleaned by a cleaning apparatus 105 which removes residual toner, paper dust or the like, and the photosensitive drum 101 is repeatedly used for forming images.

The recording material P, which passed through the fixing apparatus 107, is ejected onto a paper delivery tray 115 via the sheet path 114.

(2) Fixing Apparatus (Image Heating Apparatus) 107

Figure 5:
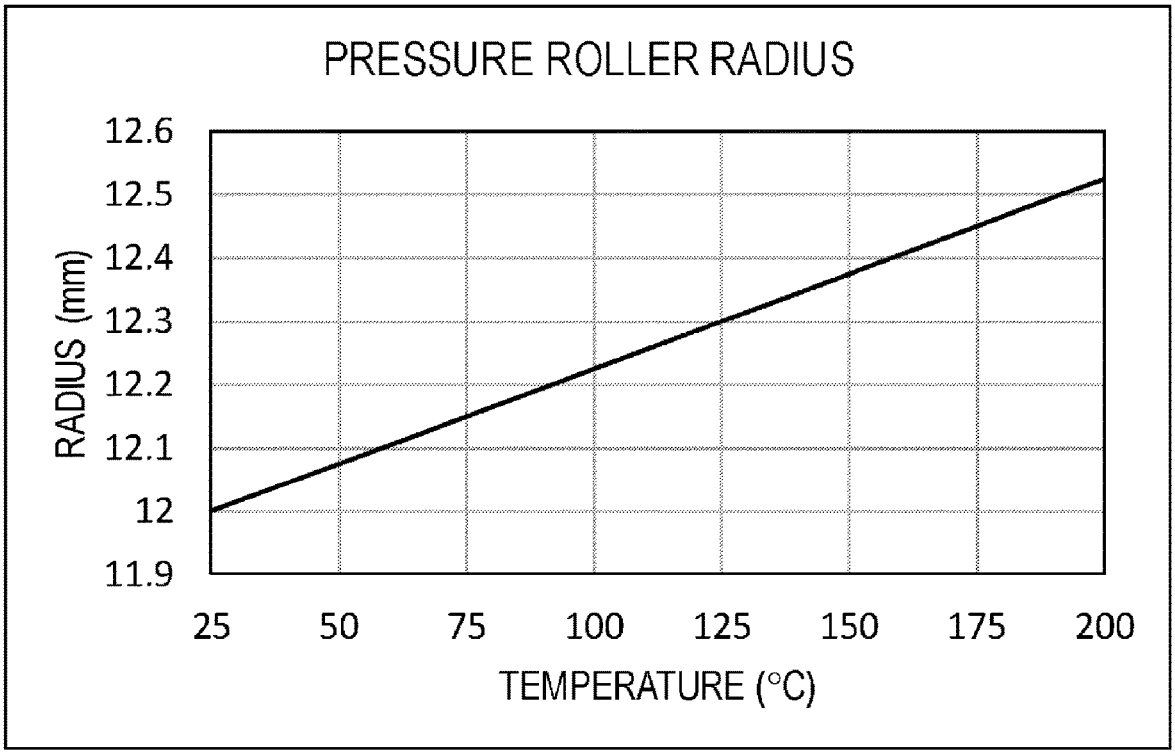
FIG. 5 is a graph depicting a thermal expansion amount of a pressure roller.

The fixing apparatus 107 according to Example 1 will be described next. FIG. 5 is a schematic block diagram depicting the film-heating type image heating apparatus according to Example 1.

The fixing apparatus 107 according to Example 1 is a tensionless film-heating type image heating apparatus. The fixing apparatus 107 uses an endless-belt type or cylindrical type heat resistance fixing film 2. At least a part of the peripheral length of the film 2 is always tension free (state where tension is not applied), and the film 2 is rotated by the rotary driving force of the pressure roller 4 which is a pressing member.

1 indicates a stay, which is a heat resistant rigid member used as both a heater holding member and a film guide member. 3 indicates a ceramic heater which is a heating member, disposed on the lower surface of the stay 1 along the longitudinal direction of the stay. 2 indicates an endless (cylindrical) heat resistant film, and is externally fitted onto the stay 1, which is a film guide member including the heater 3. The inner peripheral length of the endless heat resistant film 2 is longer than the outer peripheral length of the stay 1 including the heater 3 by about 3 mm, for example, so that the film 2 can be easily fitted externally with large margin.

The stay 1 is made of a high heat resistant resin (e.g. polyimide, polyamidimide, PEEK, PPS, liquid crystal polymer) or a composite of these resins and ceramics, metal, glass or the like. In Example 1, a liquid crystal polymer is used.

In order to decrease thermal capacity and improve quick start, the film thickness of the film 2 is not more than 100 μm, preferably not more than 50 μm and not less than 20 μm. For the structure of the film 2, a heat resistant single layer film (e.g. PTFE, PFA, FEP) or a composite layer film formed by coating PTFE, PFA, FEP or the like on the outer peripheral surface of the film (e.g. polyimide, polyamidimide, PEEK, PES, PPS). In Example 1, a film formed by coating PFA on the outer peripheral surface of a polyimide film (about a 50 μm film thickness) is used. The thickness of the PFA coat layer is about 15 μm. The outer diameter of the film 2 is 30 mm. The base layer of the film 2 may be made of metal material (e.g. SUS) instead of the above mentioned resin materials.

The heater 3 is a low thermal capacity heat source where resistance heating elements, power supplying electrodes, conductive patterns and the like are formed on a substrate. The heater 3 is fixed on the lower surface side of the stay 1. By this configuration, the entire thermal capacity can be lower compared with the thermal roller type, and a quick start becomes possible. The heater 3 will be described in detail later.

The reference numeral 4 indicates a pressure roller, which is a film driving unit that is in contact with the outer surface of the film. The pressure roller 4 forms a press-contact nip portion (fixing nip portion) N with the heater 3, holding the film 2 therebetween, and rotary-drives the film 2. This pressure roller 4 is constituted of a core metal 4*a*, an elastic layer 4*b* and a surface layer 4*c* (outermost layer), and is disposed so that the film 2 is press-contacted against the surface of the heater 3 with a predetermined pressing force, using a bearing unit and energizing unit (not illustrated). In Example 1, the core metal 4*a* is an aluminum core metal, the elastic layer 4*b* is a silicon rubber, and the surface layer 4*c* is a PFA tube of which thickness is about 50 μm. The outer diameter of the pressure roller 4 is 24 mm, and the thickness of the elastic layer 4*b* is about 3.5 mm.

The pressure roller 4 is rotary-driven by a driving system M in the clockwise direction indicated by the arrow mark, at a predetermined peripheral velocity. By the rotary-driving of the pressure roller 4, the rotating force generated by the frictional force between the pressure roller 4 and the outer surface of the film 2 is applied to the film 2 in the press-contact nip portion N. By this rotational force, the film 2 is rotated at approximately the same peripheral velocity as the rotational peripheral velocity of the pressure roller 4 in the counterclockwise direction indicated by the arrow mark around the circumference of the stay 1, while the inner surface side of the film 2 is in intimate contact with and slides on the surface of the heater 3 in the fixing nip portion N.

The temperature of the heater 3 rises when the resistance heating elements heat up by the power supplied to the power supplying electrodes of the resistance heating elements. This temperature rise is detected by thermistors 5-1 to 5-9. The outputs of the thermistors 5-1 to 5-9 are A/D converted and inputted to the CPU 11 which is a control portion, and based on the information inputted to the CPU 11, the power to energize each resistance heating element is controlled by a triac 12 using phase control, wave member control or the like, whereby the temperature of the heater 3 is controlled. In the configuration of Example 1, a plurality of thermistors are included, and the heater 3 is maintained at a predetermined temperature by controlling the energization of each resistance heating element such that the temperature of the heater 3 rises if the detected temperature of each thermistor is lower than a predetermined setting temperature, and drops if the detected temperature thereof is higher than the setting temperature. In Example 1, the output is changed in a 0 to 100% range in 81 levels (in 1.25% units) by phase control.

200 indicates a recording material information detecting unit, which determines the type and thickness of the recording material P based on the measured results of the basis weight and the surface properties of the recording material by the media sensor 201 (see FIG. 10). This information is inputted to the CPU 11, and the setting temperature of the heater 3 is determined based on this information. Here the surface properties of the recording material P indicates the physical characteristics of the surface of the recording material P, for example, such as the "coating" on the surface to increase glossiness, and the "embossing" which includes a raised pattern on the surface.

In the state where the temperature of the heater 3 has risen to a predetermined value, and the rotational peripheral velocity of the film 2, caused by the rotation of the pressure roller 4, is stabilized, the recording material P, on which the image is to be fixed, is guided from the transfer area to the press-contact nip portion N constituted of the heater 3 and the pressure roller 4 between which the film 2 is held. Then by the recording material P and the film 2 which are held and transported together through the press-contact nip portion N, the heat of the heater 3 is applied to the recording material P via the film 2, and the unfixed image (toner image) T on the recording material P is heated and fixed onto the surface of the recording material P. The recording material P, which passed through the press-contact nip portion N, is separated from the film 2 and is transported.

(3) Heater 3

Figure 2:
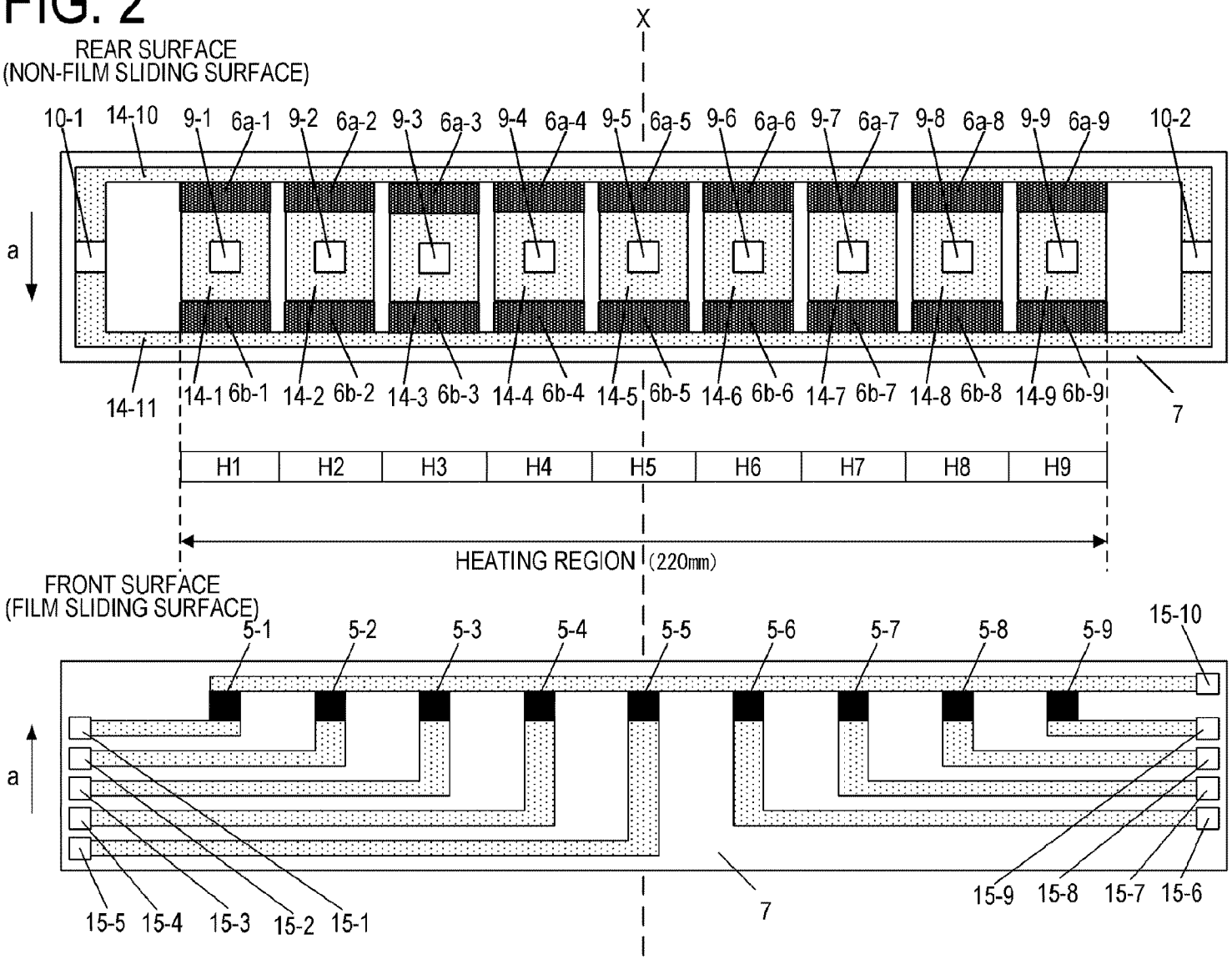
FIG. 2 is schematic representation showing front and rear surfaces of a heater according to the present invention.

The heater 3 according to Example 1 will be described next. FIG. 2 is a diagram depicting the heater 3 of Example 1 viewed from the rear surface (non-film sliding surface) and the front surface (film sliding surface).

FIG. 2 indicates a transport reference position X of the recording material P in the image forming apparatus of Example 1. The transfer reference position in Example 1 is at the center, and the recording material P is transported such that the center line of the recording material, which is orthogonal to the transporting direction thereof, moves along the transport reference position X.

The heater 3 has a long and narrow substrate 7, of which longitudinal direction is a direction orthogonal to the transporting direction a of the recording material P. On the rear surface (non-film sliding surface) side of this substrate 7, the resistance heating elements 6*a*-1 to 6*a*-9, 6*b*-1 to 6*b*-9, power supplying electrodes 9-1 to 9-9, 10-1 to 10-2 which supply power to the resistance heating elements, and conductive patterns 14-1 to 14-11 which electrically connect the resistance heating elements and the power supplying electrodes, are formed. Further, a heat resistant overcoat layer 8*b* (not illustrated in FIG. 2) is formed on the rear surface, so as to cover these resistance heating elements and conductive patterns. On the front surface (film sliding surface) side of the substrate 7, conductive patterns, which electrically connect the thermistors 5-1 to 5-9, electrodes for the thermistors 15-1 to 15-10, and conductive patterns which electrically connect the thermistors and the electrodes for thermistors, are formed. Further, a heat resistant overcoat layer 8*a* (not illustrated in FIG. 2) is formed on the front surface, so as to cover the thermistors and conductive patterns. The heater 3 according to Example 1 is a low thermal capacity heater.

7 indicates the heater substrate which has heat resistance and insulation properties, and is made of such ceramic material as aluminum oxide and aluminum nitride. In Example 1, an aluminum oxide substrate, of which width is 9 mm, length is 270 mm and thickness is 1 mm, is used.

6*a*-1 to 6*a*-9 and 6*b*-1 to 6*b*-9 are the resistance heating elements which generate heat by energization, and in Example 1, a paste, which is formulated by mixing ruthenium oxide, a glass powder (inorganic binding agent) and an organic binding agent to have a desired resistance value, is formed on the substrate 7 by screen printing. The resistance heating elements in Example 1 are disposed in nine blocks, divided in the longitudinal direction, as illustrated in FIG. 2, and are separated into 6*a* (the upstream side) and 6*b* (the downstream side) of the transporting direction a. The length of each of the nine blocks of the resistance heat elements in the longitudinal direction is 24 mm, and a space between the blocks is 0.5 mm. The overall length of the heating region is 220 mm. Each heating element block is numbered and sequentially labelled from the left in FIG. 2 as H1, H2, H3, . . . . Here H1 to H9 are disposed to be symmetric, and the center position of H5, which is the block at the center, matches with the transport reference position X of Example 1. A plurality of heating regions, which are lined up in the longitudinal direction in the fixing nip portion, are formed by these plurality of heating blocks divided in the longitudinal direction, and the temperature of each of the plurality of heating regions can be individually controlled by individually controlling the supplying power to the plurality of the heating blocks.

The configuration of the heating element block H5 will be described as an example. The heating element block H5 includes resistance heating elements 6*a*-5 (upstream side) and 6*b*-5 (downstream side), which are disposed symmetrically with respect to the vertical direction. A conductive pattern 14-5 is disposed between the resistance heating element 6*a*-5 and the resistance heating element 6*b*-5, and the resistance heating element 6*a*-5 and the resistance heating element 6*b*-5 are electrically connected. The conductive pattern 14-5 is formed by screen-printing the silver paste, and the resistance value of the conductive pattern is sufficiently lower compared with the resistance heating elements. FIG. 2 indicates a power supplying electrode 9-5 at the center of the conductive pattern 14-5. With the power supplying electrode 9-5, an electric contact (not illustrated) is brought into contact from the rear surface side of the substrate so that power is supplied. In FIG. 2, the regions of the conductive pattern 14-5 and the power supplying electrode 9-5 are separated to easily understand the structure, but actually these regions are integrated, and the total region of the conductive pattern 14-5 and the power supplying electrode 9-5 is the same silver screen-printed pattern. The power supplying electrode 9-5 is disposed at the center in the vertical direction of the substrate 7.

A conductive pattern 14-10 is formed on the upstream side of the resistance heating element 6*a*-5, and a conductive pattern 14-11 is formed on the downstream side of the resistance heating element 6*b*-5, and these conductive patterns are electrically connected to the power supplying electrodes 10-1 and 10-2 which are disposed on each end of the substrate 7 in the longitudinal direction. The conductive patterns 14-10 and 14-11 and the power supplying electrodes 10-1 and 10-2 are also silver screen printing patterns, the same as the conductive pattern 14-5. With the power supplying electrodes 10-1 and 10-2, electric contacts (not illustrated) are brought into contact from the rear surface side of the substrate so that power is supplied. As illustrated in FIG. 2, the conductive patterns 14-10 and 14-11 and the power supplying electrodes 10-1 and 10-2 are all connected, hence potentials thereof are regarded as approximately the same.

By supplying power to the power supplying electrode 9-5 and the power supplying electrodes 10-1 and 10-2, current is supplied to the resistance heating element 6*a*-5 and the resistance heating element 6*b*-5 in the transporting direction, and temperature thereof rises respectively. The resistance heating element 6*a*-5 and the resistance heating element 6*b*-5 have the same dimensions and are made of the same material, and are disposed symmetrically in the vertical direction, including the respective conductive patterns, therefore the heating values thereof are the same.

H5 was described above as an example, but configurations of H1 to H9 are all identical with H5, and the respective electric contacts (not illustrated) are in contact with the power supplying electrodes 9-1 to 9-9. In other words, in the n-th heating element block Hn, current is supplied to the resistance heating element 6*a*-*n* and the resistance heating element 6*b*-*n* in the transporting direction by supplying power to the power supplying electrode 9-*n* and the power supplying electrodes 10-1 and 10-2, and the temperatures of the resistance heating elements rise respectively. Hereafter the heating value of the heating element block Hn is assumed to be the total of the heating values of the resistance heating element 6*a*-*n* and the resistance heating element 6*b*-*n*.

FIG. 2 includes the view of the front surface (film sliding surface) of the substrate. On the front surface of the substrate, thermistors 5-1 to 5-9 are disposed as temperature detecting elements to detect the temperature of each heating element block H1 to H9. In Example 1, the thermistors 5-1 to 5-9 are formed by screen-printing a material having NTC characteristics on the substrate 7. The temperature of each H1 to H9 can be detected by detecting the resistance value of each thermistor 5-1 to 5-9. Each thermistor 5-1 to 5-9 is disposed at the center position of the respective element block in the longitudinal direction of the substrate.

On the edges of the substrate 7, electrodes 15-1 to 15-10 are disposed to input the detected results of the thermistors 5-1 to 5-9 to the CPU 11, and the thermistors 5-1 to 5-9 and the electrodes 15-1 to 15-10 are electrically connected by the conductive patterns. To detect the temperature of the n-th heating element block Hn, the resistance value of the thermistors 5-*n*, between the electrode 15-10 and the electrode 15-*n*, is detected.

In Example 1, the detected results of the thermistors 5-1 to 5-9 can be inputted to the CPU 11, so that energization of each heating element block H1 to H9 can be independently controlled. In other words, energization of each resistance heating element 6*a*-*n* and 6*b*-*n* in the n-th heating element block Hn is controlled, so that the detected result of the thermistor 5-*n* becomes a preset fixing temperature.

In FIG. 1, only one triac is illustrated, but actually one triac is disposed for each heating element block and is independently controlled. The fixing temperature of each of H1 to H9 can be set independently depending on whether the heating element block corresponds to a paper passing portion or a non-paper passing portion.

Figure 3:
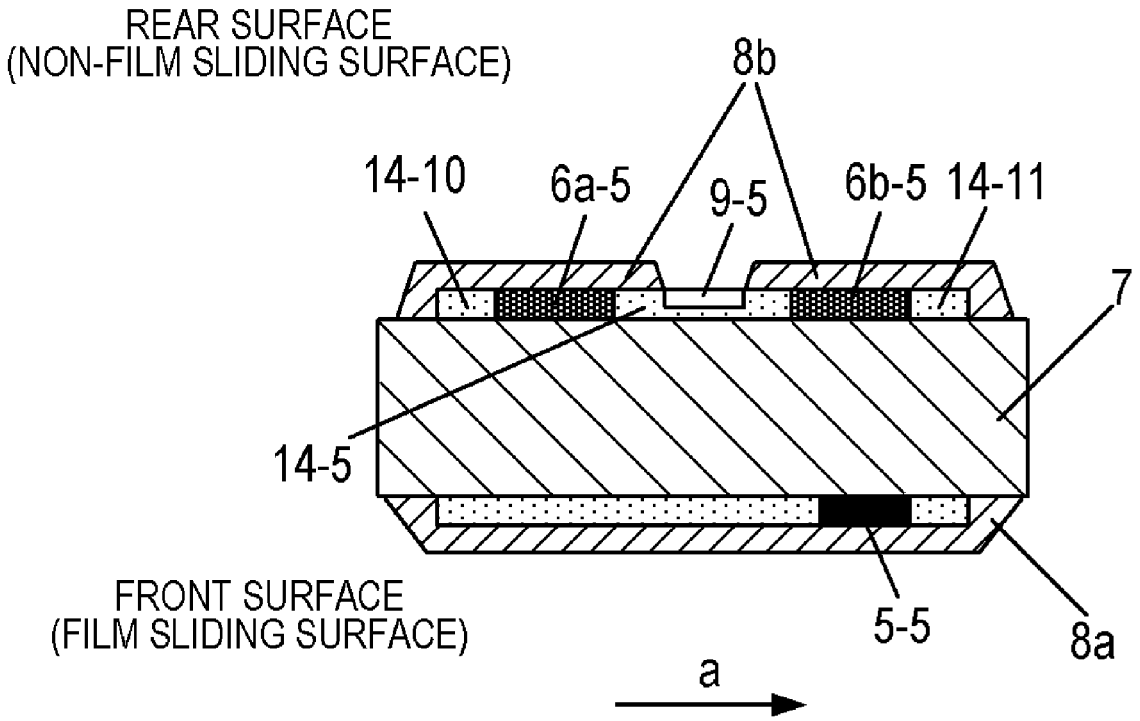
FIG. 3 is a cross-sectional view of the heater according to the present invention.

FIG. 3 is a cross-sectional view of the heater 3 sectioned at the transport reference position X indicated in FIG. 2. In FIG. 3, the heat resistant overload layers 8*a* and 8*b* (omitted in FIG. 2) are also illustrated. The heat resistant overcoat layer 8*a* is an overcoat layer disposed on the front surface of the substrate 7, in order to ensure electrical insulation of the thermistors and conductive patterns from the front surface of the heater, and to ensure slidability of the film. In Example 1, about a 50 μm thick heat resistant glass layer is used for the overcoat layer 8*a*. The heat resistant overcoat layer 8*b* is an overcoat layer disposed on the rear surface of the substrate 7 in order to ensure electrical insulation of the resistance heating elements and conductive patterns from the rear surface of the heater. However, the overcoat layer 8*b* is not disposed in the portion of the power supplying electrodes 9-1 to 9-9, because these portions must be brought into contact with the electrical contacts. The overcoat layer 8*a* is also about a 50 μm thick heat resistant glass layer.

(4) Temperature Control of Heating Element Block

Temperature control of the heating element blocks H1 to H9, which is the characteristic of the present invention, will now be described.

Figure 4:
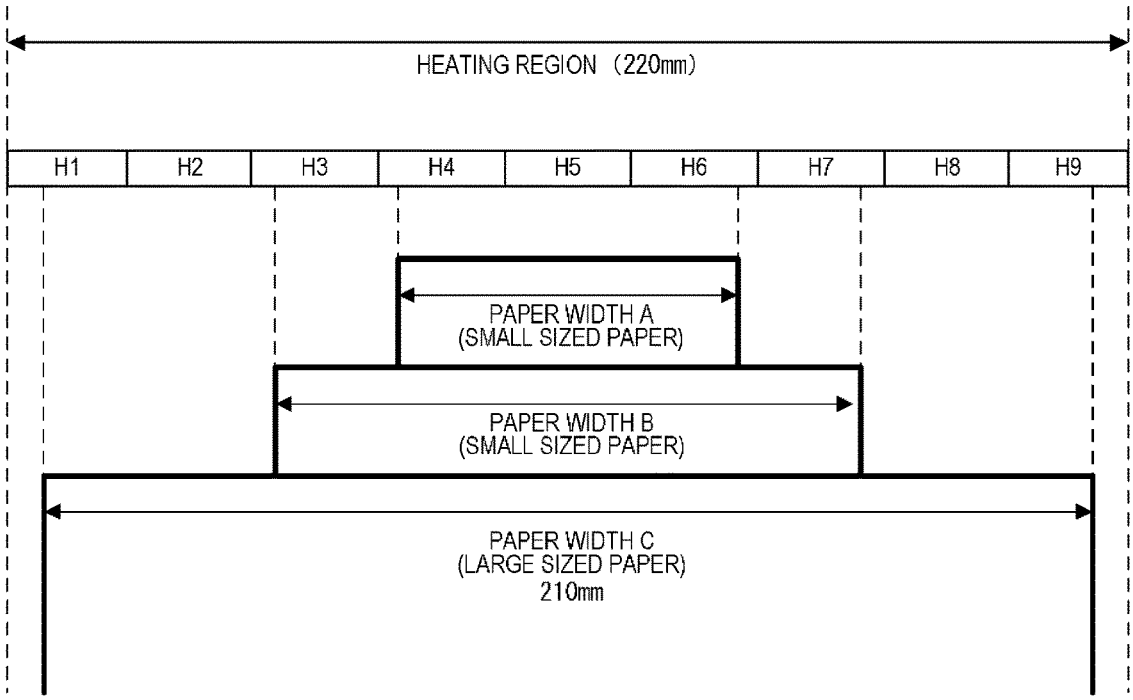
FIG. 4 is a diagram depicting a relationship between heating element blocks and a paper position according to the present invention.

FIG. 4 is a diagram depicting the positional relationship between the heating element blocks H1 to H9 and recording materials having various paper widths, according to Example 1. To simplify description herein below, the heating element blocks are classified into two categories: a paper passing block and a non-paper passing block. The paper passing block is a heating element block located in an area where a recording material passes, and a heating element block, located in an area which includes a paper end and a part of which becomes a non-paper passing portion is also defined as the paper passing block. The non-paper passing block is defined as a heating element block located in an area where the recording material does not pass through at all. According to this classification, in the case of passing a recording material having the paper width B, the paper passing blocks are H3 to H7, and the non-paper passing blocks are H1, H2, H8 and H9.

The recording material having the paper width C in FIG. 4 is an A4 sized recording material (paper width: 210 mm), which is the maximum width (large sized paper) of Example 1, and in the case of passing a recoding material having the paper width C, all of H1 to H9 become the paper passing blocks. The recording material having the paper width A in FIG. 4 is an example of a recording material of which width is narrower than the paper width B, and in this case, H4 to H6 become the paper passing blocks. Table 1 shows the classification of heating element blocks in the case where a recording material having the A, B or C paper width is passed.

TABLE 1

Classification of heating element blocks

| Recording material | Paper passing block | Non-paper passing block |
|---|---|---|
| Paper width A | H4 to H6 | H1 to H3 and H7 to H9 |
| Paper width B | H3 to H7 | H1, H2, H8, and H9 |
| Paper width C | H1 to H9 | None |

In the following description, a case of passing a recording material having the paper width B will be described as an example.

In Example 1, an example of changing the heating values of the paper passing block and the non-paper passing block indicated in Table 1 in accordance with the information of the recording material, in the case of passing of the recording material having the paper width B, will be described.

First, the paper passing block will be described.

The recording material having the paper width B is fed from the paper feeding cassette 109, and the surface properties and the basis weight thereof are detected by the media sensor 201 disposed in the sheet path 112. In the recording material information detecting unit 200, the measured surface properties and basis weight values of known recording materials and actual thickness information have been stored, so that the recording material can be determined based on the surface properties and basis weight detected by the media sensor 201, and the thickness of the recording material can be predicted.

The recording material detecting unit 200 sends the detected recording material information to the CPU, and based on this information, the CPU determines the fixing temperature of the paper passing blocks H3 to H7 (in the case of the paper width B) to fix the unfixed toner image on the recording material. While the fixing operation is performed on the recording material, energization of the heating element blocks H3 to H7 is controlled so that the detected temperatures of thermistors 5-3 to 5-7 become constant (maintained) at the determined control temperature (control target temperature).

Table 2 indicates an example of the control temperatures. The column of the recording material type in Table 2 indicates the standard types of paper, which are used in the following description, but the present invention is not limited to specific types of paper.

TABLE 2

Example of control temperature

| Examples of recording material type | Basis weight ($g/m^2$) | Thickness (μm) | Control temperature (° C.) |
|---|---|---|---|
| Plain paper | 68 | 92 | 200 |
| Thick paper | 128 | 150 | 220 |
| Postcard | 209 | 220 | 250 |

The non-paper passing block will be described next.

The non-paper passing block is a region where the recoding material does not pass through, hence it is unnecessary to heat the heating blocks H1, 2, 8 and 9 if only energy conservation is considered. However, as described above in SUMMARY OF THE INVENTION, in the case where the non-paper passing block is not energized, a velocity difference is generated between the recording material P and the film 2 in the nip, which may cause a local abrasion of the film 2. Therefore in Example 1, the control temperature of the non-paper passing block is changed depending on the thickness of the recording material to be passed, so that no difference is generated between the transporting velocity of the recording material P and the rotational peripheral velocity of the film 2 in the nip. In order to match the transporting velocity of the recording material and the rotational peripheral velocity of the film 2, the following configuration is required. That is, the sum of the radius r [paper passing portion] of the pressure roller 4 at a position corresponding to the paper passing block and the thickness of the recording material (r [paper passing portion]+d) must be the same as the radius r [non-paper passing portion] of the pressure roller 4 at a position corresponding to the non-paper passing block.

FIG. 5 is a graph depicting a relationship between the temperature and the radius of the pressure roller 4.

The radius of the pressure roller 4 was measured using a fully automatic roller measurement apparatus RSV 860-3C/S2 manufactured by Tokyo Opto-Electronics Co. Ltd. Measurement was performed while rotating the pressure roller 4, and the outer diameter of the pressure roller was measured in the rotational circumferential direction every 90° (at four points in the circumferential direction), and the average value thereof was calculated. The radius is a value determined by dividing the calculated outer diameter by 2. This measurement was repeated while changing the temperature of the pressure roller 4, and the graph in FIG. 5 was created. In concrete terms, the pressure roller 4, which was left in the thermostatic chamber at 230° C. for at least 2 hours, was set in the above mentioned apparatus, and the surface temperature of the pressure roller 4 was monitored by a radiation thermometer, and measurement was performed when the surface temperature drops to 150° C. The result of this measurement was regarded as the radius of the pressure roller 4 at 150° C.

As mentioned above, the radius of the pressure roller 4 is 12 mm at room temperature (25° C.). As indicated in FIG. 5, the radius of the pressure roller 4 increases at a rate of 3 μm/° C. by the thermal expansion of the silicon rubber layer as the temperature increases from the room temperature (25° C.).

In the case where the plain paper indicated in Table 2 is passed as the recording material, the paper passing blocks H3 to H7 are controlled so that the detected temperatures of the thermistors 5-3 to 5-7 become 200° C. At this time, in actual measurement, the temperature of the pressure roller 4 at the positions corresponding to the paper passing blocks H3 to H7 were about 80° C. As indicated in FIG. 5, the radius r [paper passing portion] of the pressure roller 4 at a position corresponding to the paper passing block is r [paper passing portion]=12.17 mm. The thickness d of the plain paper is d=92 μm. This means that r [paper passing portion]+d=12.26 mm. Therefore in order to equalize the rotational peripheral velocity of the film 2 with the transporting velocity of the plain paper, the radius r [non-paper passing portion] of the pressure roller 4 at a position corresponding to the non-paper passing block must be r [non-paper passing portion]=12.26 mm. As indicated in FIG. 5, in order to set r [non-paper passing portion]=12.26 mm, the temperatures of the pressure roller 4 at the positions corresponding to the non-paper passing block must be 112° C. Hence in Example 1, the control temperatures of the non-paper passing blocks H1, 2, 8 and 9 in the case of passing the plain paper are set to 120° C., which is slightly higher than 112° C. This value is determined by adding the drop in temperature in the case when the heat is transferred from the heater 3 to the pressure roller 4 via the film 2.

In the same manner, in the case where the thick paper having a 150 μm. In thickness indicated in Table 2 is passed as a recording material, the heating elements H3 to H7 in the paper passing blocks are controlled to 220° C. At this time, the temperatures of the pressure roller 4 at positions corresponding to the paper passing blocks were about 80° C. Based on the same concept as the case of passing plain paper, r [paper passing portion]+d is 12.32 mm. In order to set r [non-paper passing portion]=12.32 mm, the temperatures of the pressure roller 4 at the positions corresponding to the non-paper passing blocks must be 132° C. Hence in Example 1, the control temperatures of the non-paper passing blocks H1, 2, 8 and 9, in the case of passing thick paper, are set to 140° C.

In the case where a postcard having a 220 μm thickness indicated in Table 2 is passed as the recording material, the heating elements H3 to H7 in the paper passing blocks are controlled to 250° C. At this time, the temperatures of the pressure roller 4 at positions corresponding to the paper passing blocks were also about 80° C. Therefore r [paper passing portion]+d is 12.39 mm. In order to set r [non-passing passing portion]=12.39 mm, the temperatures of the pressure roller 4 at the positions corresponding to the non-paper passing blocks must be 155° C. Hence in Example 1, the control temperatures of the non-paper passing blocks H1, 2, 8 and 9, in the case of passing a postcard, is set to 165° C.

Table 3 indicates examples of the recording materials to be passed and the respective control temperatures of the heating elements in the non-paper passing blocks according to Example 1.

TABLE 3

Control temperatures of paper passing block and non-paper passing block

| Recording material | Basis weight ($g/m^2$) | Thickness (μm) | Paper passing portion control temperature (° C.) | Non-paper portion control temperature (° C.) |
|---|---|---|---|---|
| Plain paper | 68 | 92 | 200 | 120 |
| Thick paper | 128 | 150 | 220 | 140 |
| Postcard | 209 | 250 | 250 | 175 |

(5) Confirming Effect

Using a conventional image heating apparatus and the image heating apparatus of Example 1 respectively, a government printed postcard (basis weight: 209 $g/m^2$; thickness: 220 μm) and B5 sized Canon CS-680 paper (basis weight: 68 $g/m^2$; thickness: 92 μm) were passed, and the comparative experiments were performed.

In the case of the conventional image heating apparatus, which places importance on energy conservation, the control temperature of the heating elements in the non-paper passing blocks is 100° C., regardless the thickness of the paper to be passed. In other words, the heating elements in the non-paper passing blocks are controlled to 100° C. whether a government printed postcard or CS-680 paper is passed. Table 4 indicates the paper passing portion control temperature and the non-paper passing portion control temperature in the case of the comparative example and Example 1.

TABLE 4

Control temperature of comparative example and Example 1

| | Paper type | Paper passing portion control temperature (° C.) | Non-paper passing portion control temperature (° C.) |
|---|---|---|---|
| Comparative example | CS-680 | 200 | 100 |
| | Government printed postcard | 250 | 100 |
| Example | CS-680 | 200 | 120 |
| | Government printed postcard | 250 | 175 |

Figure 9:
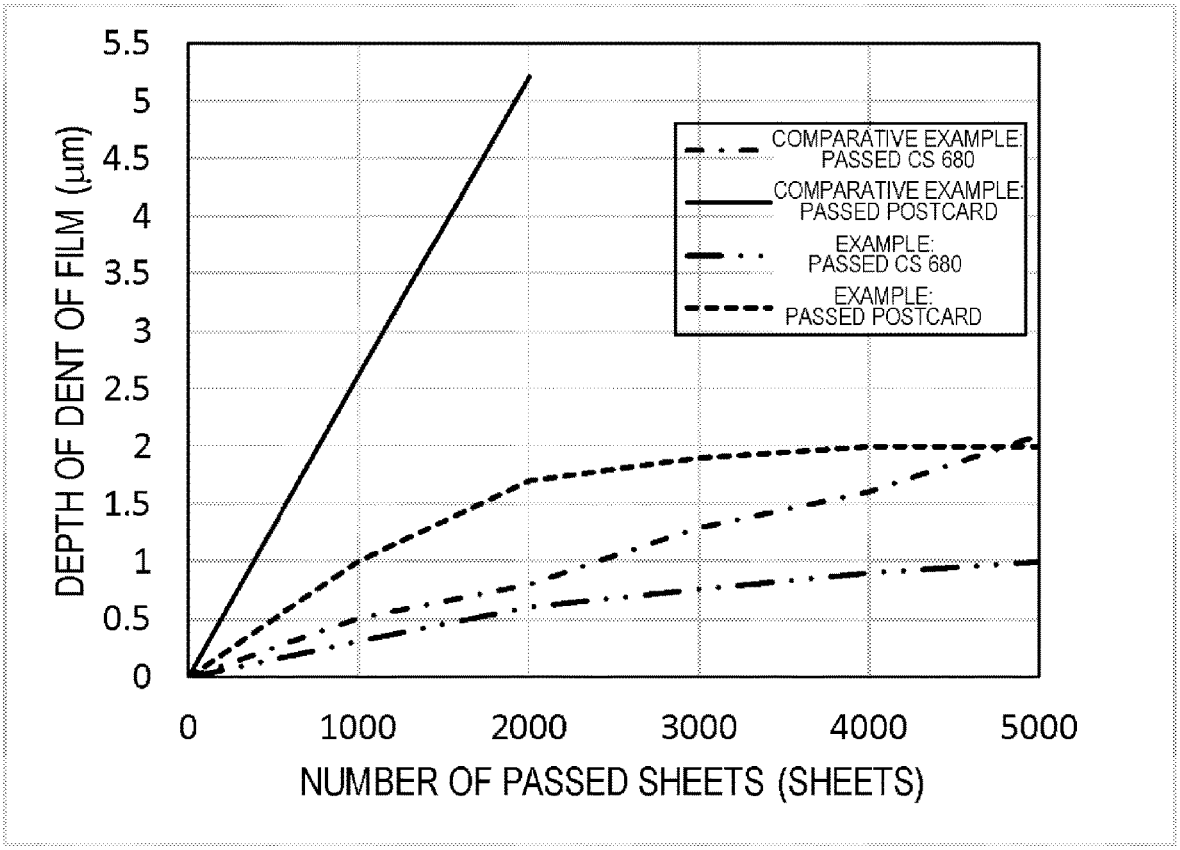
FIG. 9 is a graph depicting the effect of Example 1.

FIG. 9 is a graph depicting a depth of a dent of the film at the paper edge portions when the above mentioned two types of paper were passed, and the abscissa indicates a number of sheets that passed; and the ordinate indicates the depth of the dent of the film.

It is known that an image defect is generated if a large sized paper is passed when the depth of the dent of the film exceeds 5 μm.

As indicated in FIG. 9, in the case of the conventional image heating apparatus, the depth of the dent of the film exceeded 5 μm when about 2000 government printed postcards were passed, and an image defect (gloss unevenness, fixing defect) occurred when a large sized paper was passed thereafter. On the other hand, in the case of the image heating apparatus of Example 1, the depth of the dent of the film remains about 2μ even if 5000 government printed postcards were passed.

In the case of passing CS-680 paper, the depth of the dent of the film of the conventional image heating apparatus is about 2 μm, and the depth of the dent in the image heating apparatus of Example 1 is about 1 μm at a point when 5000 sheets were passed. In either case, image defects were not generated, but the depth of the dent of the film is less if the configuration of Example 1 is used, whereby the effect can be confirmed.

As indicated in FIG. 9, the difference between the transporting velocity of the recording material and the rotational peripheral velocity of the film 2 can be decreased by increasing the control temperature of the heating elements in the non-paper passing blocks as the thickness of the recording material to be passed increases, using the configuration of Example 1. As a result, the dent and scratches of the film 2, due to local abrasion caused by passing small sized paper, can be suppressed.

In the description in Example 1, the thickness of the recording material is detected by predicting the thickness based on the detection of the basis weight and surface properties by the media sensor. Instead of this method, however, the user may directly input the basis weight and the thickness of the recording material to be passed, so as to acquire detailed information of the recording material.

This input may be input from such an external apparatus as a PC or may be input from the operation panel 202 (FIG. 10), which is an information input portion disposed in the image forming apparatus.

To simplify description, the divided heating element blocks have the same length in the configuration of Example 1, but the length of each heating element may be different from each other depending on the paper widths of the standard sized recording materials to be passed. A number of the divisions is not limited to nine either. In the above description, the shape of the heating element block is horizontally and vertically symmetric with respect to the longitudinal direction of the heater substrate, but shape is not limited to a symmetric shape.

Example 2

In Example 1, a case of disposing thermistors 5-1 to 5-9 on the front surface side of the substrate 7 of the heater 3 was described. In Example 2, a case of including a temperature detecting member, which detects the temperature of the pressure roller 4, in addition to the thermistors 5-1 to 5-9 on the substrate 7 of the heater, will be described. The image forming apparatus according to Example 2 is the same as Example 1.

Figure 6:
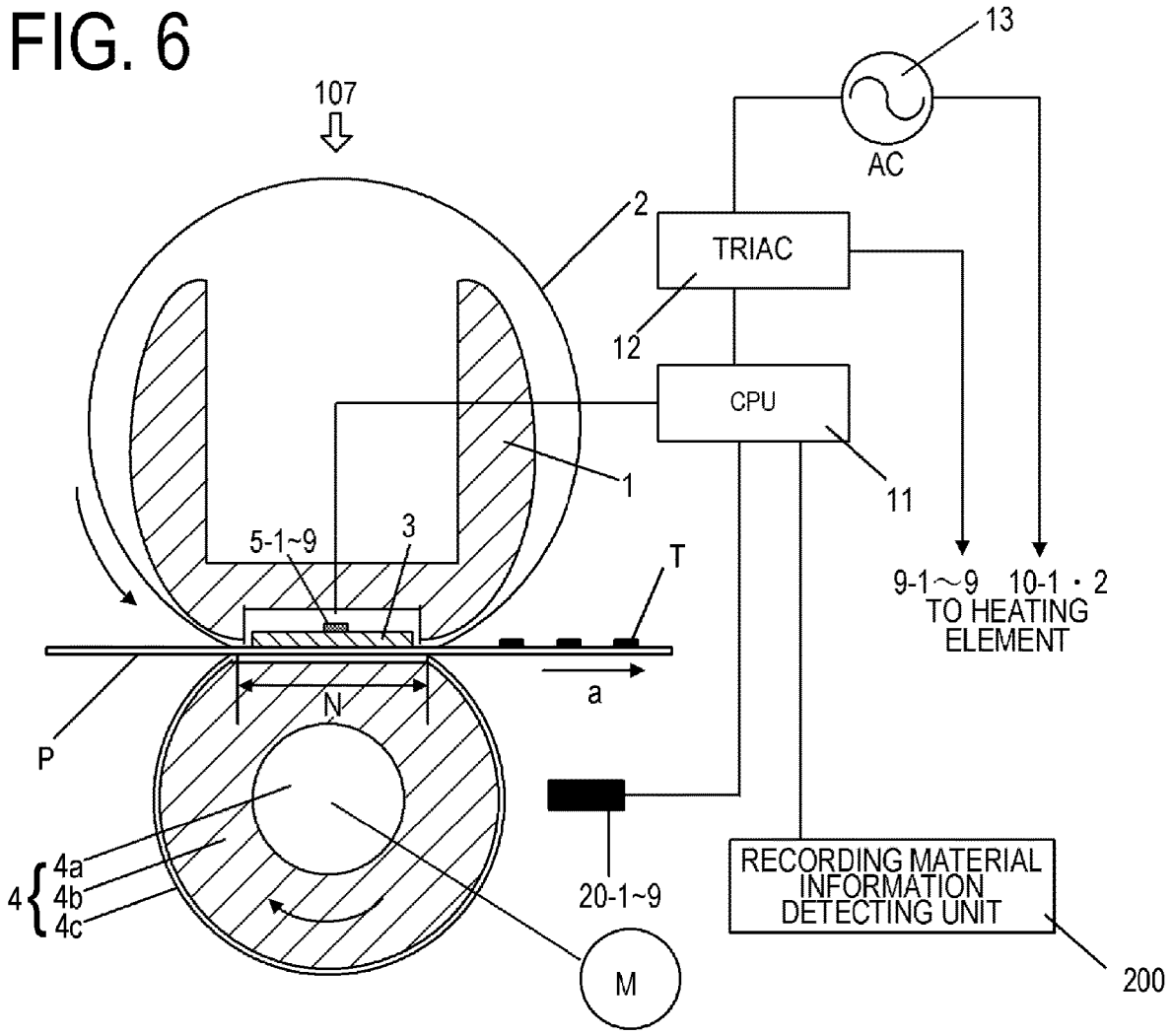
FIG. 6 is a schematic block diagram depicting an image heating apparatus according to Example 2.

FIG. 6 is a schematic block diagram depicting an image heating apparatus according to Example 2. Since the basic configuration is the same as the image heating apparatus of Example 1, a member the same as Example 1 is denoted with a same reference sign. In the image heating apparatus of Example 2, pressure roller temperature detecting elements 20-1 to 20-9, which detect the temperature of the pressure roller 4, are disposed. For example, the pressure roller temperature detecting element 20-1 detects the temperature of the position corresponding to the heating element block H1, and 20-2 detects the temperature of a position corresponding to the heating element block H2 in the longitudinal direction of the pressure roller. In other words, the pressure roller temperature detecting element **20-*n* detects the temperature of the pressure roller 4** at a position corresponding to each heating element block Hn. In Example 2, a thermopile, which is a non-contact temperature detecting element, is used as the pressure roller temperature detecting element.

Temperature control of heating element blocks H1 to H9 according to Example 2 will be described using an example of a case of passing the recording material having paper width B indicated in FIG. 4, as the recording material, will be described in the same manner as Example 1.

The recording material is fed into the image forming apparatus, where the surface properties and the basis weight of the paper are detected by the recording material information detecting unit 200, and the thickness of the paper is predicted. Then the control temperature of the paper passing blocks (H3 to H7) is determined in accordance with the result in the same manner as Table 2 in Example 1, and energization of the heating element blocks H3 to H7 is controlled so that the temperature thereof become constant at the control temperature.

In Example 2, the temperature of the pressure roller 4 at the positions corresponding to the paper passing blocks and the non-paper passing blocks can be detected. Therefore the temperature of the pressure roller 4 at the positions corresponding to the paper passing blocks is calculated as an average value of the detection results of the pressure roller temperature detecting elements 20-3 to 20-7. Based on the temperature of the pressure roller 4 in the paper passing blocks and FIG. 5, the radius r [paper passing portion] of the pressure roller in the paper passing blocks is calculated. From this r [paper passing portion] and the thickness d of the recording material indicated in Table 2, radius r [non-paper passing portion] of the pressure roller in the non-paper passing portions=r [paper passing portion]+d, to equalize the transporting velocity of the recording material and the rotational peripheral velocity of the film, can be calculated. Once r [non-paper passing portion] is calculated, the temperature, to which the pressure roller should be controlled at the positions corresponding to the non-paper passing blocks, is known based on the result in FIG. 5. Then energization of the non-paper passing blocks H1, H2, H8 and H9 is controlled so that the temperature detection results of the pressure roller temperature detecting elements 20-1, 20-2, 20-8 and 20-9 become constant at the above mentioned control temperature.

In the case of a postcard in Table 2, for example, the heating blocks H3 to H7 of the paper passing blocks are controlled to 250° C. when the postcard is passed. At this time, the temperatures of the pressure roller at the positions corresponding to the paper passing blocks are detected at about 80° C. by the pressure roller temperature detecting elements 20-3 to 20-7. Therefore the radius at a position corresponding to the paper passing block of the pressure roller 4 is r [paper passing portion]=12.17 mm. Considering the thickness of the postcard d=220 μm, the temperature of the non-paper passing blocks must be controlled so that the radius of the pressure roller 4 at the positions corresponding to the non-paper passing blocks becomes r [non-paper passing portion]=r [paper passing portion]+d=12.17+0.22=12.39 mm. Hence energization of the heating elements H1, H2, H8 and H9 of the non-paper passing blocks is controlled so that the detected temperatures of the pressure roller temperature detecting elements 20-1, 20-2, 20-8 and 20-9 become constant at 155° C.

In Example 2, a case of including the temperature detecting elements, which detect the temperature of the pressure roller 4, was described. The pressure roller temperature detecting element here may be a non-contact type that is not in contact with the surface of the pressure roller 4 as illustrated in FIG. 6, or may be a contact type that is in contact with the surface of the pressure roller 4.

By using the configuration of detecting the temperatures of the pressure roller 4 at the positions corresponding to the paper passing blocks and the non-paper passing blocks as in Example 2, the temperatures of the pressure roller 4 in the longitudinal direction can be directly monitored and controlled. As a result, the radiuses of the pressure roller 4 at the paper passing portion and the non-paper passing portion can be more accurately controlled than Example 1, and the velocity difference between the recording material and the film can be decreased, whereby the generation of local abrasion of the film when small sized paper is passed can be suppressed.

Example 3

In Example 3, a case of predicting the thickness of the recording material, even if there is no input of accurate thickness information of the recording material by a media sensor or the user, will be described. The configuration of the image heating apparatus is the same as Example 2.

In the case of an image forming apparatus which does not include a media sensor, the user normally selects an appropriate print mode out of a plurality of print modes which are set in advance, whereby the image forming and fixing operations are performed.

In Example 3, a recommended print mode is provided for each basis weight range of the recording material, as indicated in Table 5, so that the user can select a print mode in accordance with the basis weight of the recording material to be used. The control temperature of the paper passing blocks in the image heating apparatus is predetermined for each print mode, and are controlled to be the control temperature of the selected print mode. The print modes in Table 5 are just examples according to Example 3, and more print modes or less print modes may be included in actual application.

TABLE 5

| Print modes | | |
|---|---|---|
| Print mode | Basis weight range g/m$^2$ | Control temperature (° C.) |
| Plain paper mode | 60 to 90 | 200 |
| Thick paper mode | 91 to 150 | 220 |
| Extra thick paper mode | 151 to 250 | 250 |
| Envelope mode | 80 to 200 | 230 |
| Gloss paper mode | 120 to 220 | 250 |

Just like the description of Example 1 and Example 2, a case of passing the recording material having paper width B will be described. To simplify description, a case of selecting the extra thick paper mode, out of the print modes listed in Table 5, will be described as an example.

In the case where the extra thick paper mode is selected, energization of the paper passing blocks H3 to H7 is controlled so that the detected temperatures of the thermistors 5-3 to 5-7 become constant at 250° C.

The thickness of the paper is considerably different whether paper of which basis weight is the minimum (151 g/m$^2$) is passed or paper of which basis weight is the maximum (230 g/m$^2$) is passed, hence the temperatures to be set as the control temperature of the non-paper passing blocks is also considerably different.

Therefore in Example 3, the basis weight of the paper to be passed is predicted based on the detected temperatures of the pressure roller temperature detecting elements 20-3 to 20-7 at the positions corresponding to the paper passing blocks.

Generally the basis weight of the paper and the thickness of the paper have a certain degree of correlation if the type of the paper (e.g. premium grade paper, envelope, coated glossy paper) is the same. Therefore if the basis weight in the selected print mode can be predicted, thickness can also be predicted.

Figure 7:
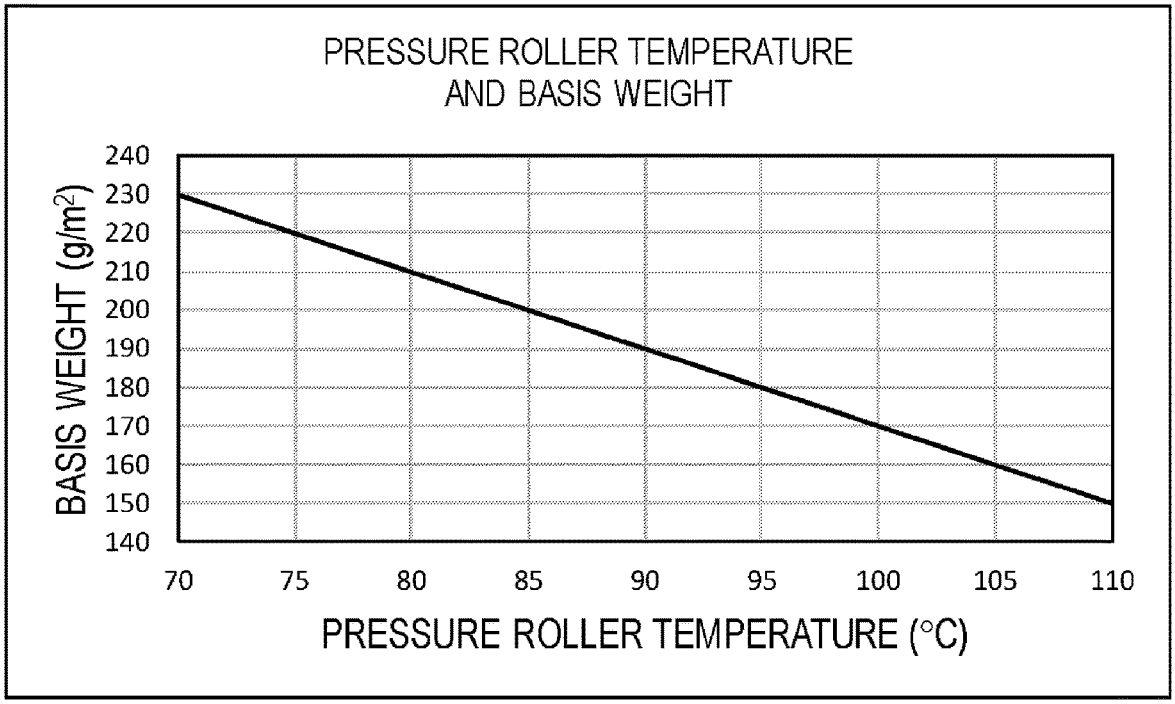
FIG. 7 is a graph depicting a relationship between the pressure roller temperature and the basis weight according to Example 3.

FIG. 7 is a graph depicting the relationship between the temperature of the pressure roller 4 and the basis weight of the paper in the case of controlling the energization of the heating element blocks H3 to H7, so that the detected temperatures of the thermistors 5-3 to 5-7 become constant at 250° C.

Figure 8:
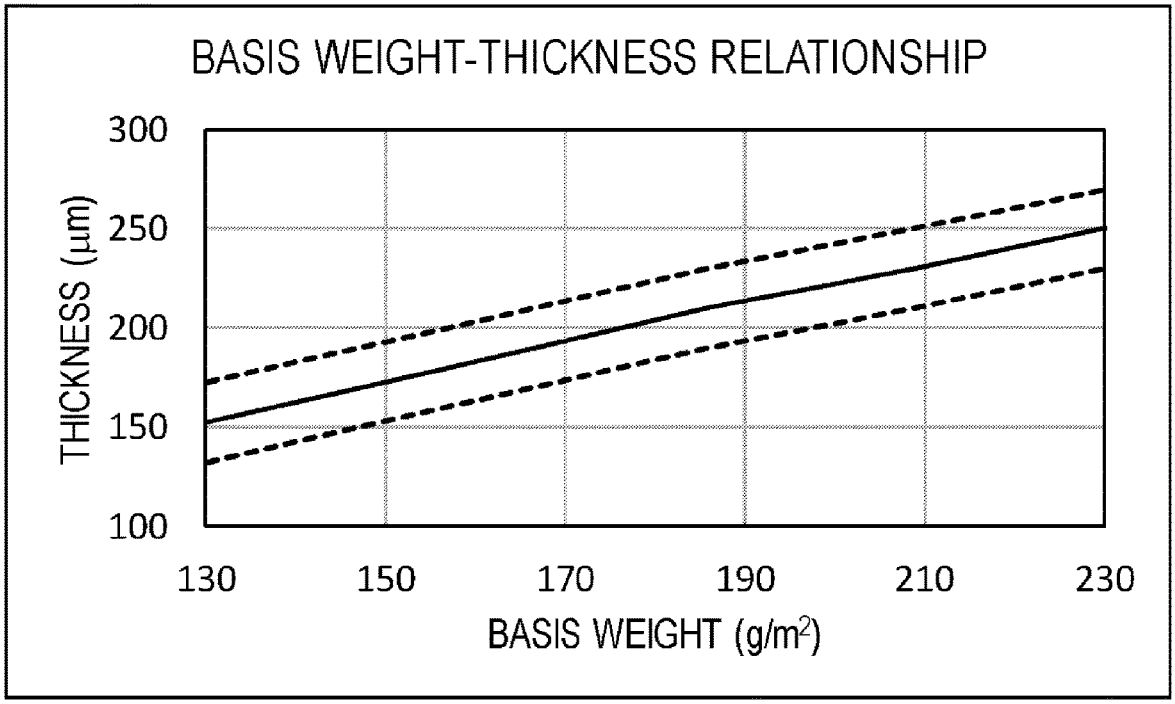
FIG. 8 is a graph depicting the relationship between the basis weight and the thickness of paper.

As indicated in FIG. 7, in the case of passing the paper of which basis weight is about 150 g/m$^2$, the temperature of the pressure roller 4 is 110° C., and in the case of passing the paper of which basis weight is about 230 g/m$^2$, the temperature of the paper passing portions of the pressure roller 4 is 70° C. This is because when the heat amount supplied from the heating elements is the same, more heat is absorbed as the basis weight of the recording material to be passed increases, that is, the heat transfer amount to the pressure roller decreases. In other words, the basis weight of the paper that is passed can be predicted based on the detected temperatures of the pressure roller temperature detecting elements 20-3 to 20-7. If the basis weight can be predicted, the thickness of the paper can be predicted. The basis weight of the paper that is passed is calculated based on the temperatures detected by the pressure roller temperature detecting elements 20-3 to 20-7, and the thickness of the paper is predicted based on the result in FIG. 8. FIG. 8 is a graph depicting the relationship between the basis weight and the thickness of the paper classified as premium grade paper, which is used as standard copy paper. In FIG. 8, the solid line indicates the center value, and the above relationship varies within the range of the broken lines.

For example, if the detected result of the pressure roller temperature detecting element is 80° C., the basis weight of the paper that is passed according to FIG. 7 is predicted as 210 g/m$^2$ in Example 3. In this case, the thickness is predicted as about 210 to 250 μm according to FIG. 8. Here the relationship between the basis weight and the thickness varies depending on the type and material properties of the recording material, hence the prediction reflects some variation. In Example 3, the center value of the prediction result is used as the value of the thickness. In other words, in this case, the thickness of the paper is regarded as 230 μm.

After the thickness d of the recording material that is passed is calculated as about 230 μm by the CPU, the control is performed as described in Example 2. In other words, energization of the heating elements in the paper passing blocks and the non-paper passing blocks is controlled, so that the radius of the pressure roller 4 in the longitudinal direction becomes r [paper passing portion]+d=r [non-paper passing portion].

In Example 3, only the example of premium grade paper was described to simplify description, but even if the print mode is the gloss paper mode, envelope mode or the like, the thickness can be predicted using the relationship between the basis weight and the thickness in accordance with the type of the recording material.

As described above, in Example 3, the basis weight and the thickness of the recording material that is passed are predicted based on the relationship between the control temperature of the heater and the temperature of the pressure roller in the paper passing portions. Thereby the thickness of the recording material can be predicted even if the detected information by the recording material information detecting unit (e.g. media sensor) or accurate thickness information inputted by the user are not available.

As a result, an increase in the size and cost of the apparatus, caused by disposing a media sensor on the sheet path, for example, does not occur. Further, local abrasion of the film can be suppressed without imposing on the user to input accurate thickness information.

Each configuration of the above examples may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-141390, filed on Jul. 27, 2018, which is hereby incorporated by reference herein in its entirety.

What is claimed is:

1. An image heating apparatus, comprising:

an image heating portion, which includes a tubular film, a heater provided in an inner space of the film and having a plurality of heating elements which are arranged in a direction orthogonal to a transporting direction of a recording material and a pressure member configured to form a nip portion between the pressure member and an outer surface of the film, the image heating portion heats an image formed on the recording material using a heat of the heater at the nip portion; and a control portion which controls the plurality of heating elements individually, wherein the image heating apparatus includes an acquiring portion which acquires thickness information of the recording material, wherein the control portion controls a power to be supplied to the heating element which heats a region where the recording material does not pass through among the plurality of heating elements based on a control target temperature which is set based on the thickness information, wherein the image heating apparatus further includes, a first temperature detecting portion which detects the temperature of the heater for each of a plurality of regions which are divided in the direction orthogonal to the transporting direction corresponding to a plurality of heating regions which are heated by the plurality of heating elements, a second temperature detecting portion which detects the temperature of the pressure member for each of a plurality of regions which are divided in the direction orthogonal to the transporting direction corresponding to the plurality of heating regions, and wherein the acquiring unit acquires the thickness information based on the detected temperature of the first temperature detecting portion and the detected temperature of the second temperature detecting portion in regions corresponding to the heating regions where the recording material passes through among the plurality of heating regions.

2. The image heating apparatus according to claim 1, wherein the control target temperature is set to be higher as the thickness of the recording materials increases.

3. The image heating apparatus according to claim 1, wherein the image heating apparatus further includes an input portion to which information on a recording material is to be inputted by a user, wherein the acquiring unit acquires the thickness information based on the information on the recording material, the information being inputted by the user.

4. The image heating apparatus according to claim 1, wherein the image heating apparatus further includes a detecting portion which detects a basis weight of a recording material, wherein the acquiring unit acquires the thickness information based on the basis weight detected by the detecting portion.

5. The image heating apparatus according to claim 1, wherein the control portion controls heating of the heating regions where the recording material does not pass through among the plurality of heating regions so that the detected temperature of the second temperature detecting portion in regions corresponding to the heating regions maintains the control target temperature.

6. The image heating apparatus according to claim 1, wherein the control target temperature is lower than a control target temperature to control the heating of heating regions where the recording material passes through among the plurality of heating regions.

7. The image heating apparatus according to claim 1, wherein the heater further includes a substrate on which the plurality of heating elements are arranged.

8. An image forming apparatus, comprising:

an image forming portion which forms an image on a recording material; and a fixing portion which fixes an image formed on a recording material to the recording material, wherein the fixing portion is the image heating apparatus according to claim 1.

9. An image forming apparatus for forming a toner image on a recording material, comprising:

an image forming portion configured to form the toner image on the recording material;

a fixing portion configured to fix the toner image on the recording material, the fixing portion includes a tubular film, a heater provided in an inner space of the film and including a substrate and a plurality of heating blocks arranged on the substrate in a longitudinal direction of the heater, a roller configured to form a nip portion for nipping and conveying the recording material in cooperation with the heater through the film, a plurality of first temperature detecting elements configured to detect respective temperatures of the plurality of heating blocks, and a plurality of second temperature detecting elements configured to detect respective temperatures of areas of the roller corresponding to the plurality of heating blocks in the longitudinal direction of the heater; and a controller configured to control power to be supplied to the plurality of heating blocks individually, wherein the controller controls power to be supplied to the plurality of heating blocks in accordance with temperatures detected by the plurality of first temperature detecting elements and temperatures detected by the plurality of second temperature detecting elements.

10. The image forming apparatus according to claim 9, wherein the plurality of heating blocks includes a first heating block and a second heating block, wherein the controller controls a power to be supplied to the first heating block in accordance with a temperature detected by one of the plurality of first temperature detecting elements which detects a temperature of the first heating block and a temperature detected by one of the plurality of second temperature detecting elements which detects a temperature of area of the roller corresponding to the first heating block, and wherein the controller controls a power to be supplied to the second heating block in accordance with a temperature detected by one of the plurality of first temperature detecting elements which detects a temperature of the second heating block and a temperature detected by one of the plurality of second temperature detecting elements which detects a temperature of area of the roller corresponding to the second heating block.

11. A fixing apparatus for fixing a toner image formed on a recording material to the recording material, comprising:

a tubular film;

a heater provided in an inner space of the film and including a substrate and a plurality of heating blocks arranged on the substrate in a longitudinal direction of the heater;

a roller configured to form a nip portion for nipping and conveying the recording material in cooperation with the heater through the film;

a plurality of first temperature detecting elements configured to detect respective temperatures of the plurality of heating blocks; and a plurality of second temperature detecting elements configured to detect respective temperatures of areas of the roller corresponding to the plurality of heating blocks in the longitudinal direction of the heater.

12. The fixing apparatus according to claim 11, further comprising a controller configured to control power to be supplied to the plurality of heating blocks individually, wherein the plurality of heating blocks includes a first heating block and a second heating block, wherein the controller controls a power to be supplied to the first heating block in accordance with a temperature detected by one of the plurality of first temperature detecting elements which detects a temperature of the first heating block and a temperature detected by one of the plurality of second temperature detecting elements which detects a temperature of area of the roller corresponding to the first heating block, and wherein the controller controls a power to be supplied to the second heating block in accordance with a temperature detected by one of the plurality of first temperature detecting elements which detects a temperature of the second heating block and a temperature detected by one of the plurality of second temperature detecting elements which detects a temperature of area of the roller corresponding to the second heating block.

* * * * *